US006476300B1

(12) United States Patent
Kurosaki

(10) Patent No.: US 6,476,300 B1
(45) Date of Patent: Nov. 5, 2002

(54) MUSICAL INSTRUMENT STAND

(75) Inventor: Makoto Kurosaki, Hamamatsu (JP)

(73) Assignee: Yamaha Corp. (JP)

( * ) Notice: Subject to any disclaimer, the term of this patent is extended or adjusted under 35 U.S.C. 154(b) by 0 days.

(21) Appl. No.: 09/677,640

(22) Filed: Oct. 3, 2000

(30) Foreign Application Priority Data

Oct. 8, 1999 (JP) ..... 11-287975

(51) Int. Cl.[7] ..... G10D 3/00

(52) U.S. Cl. ..... 84/327; 84/421; 84/422.1; 84/422.2

(58) Field of Search ..... 84/421, 422.1, 84/422.2, 422.3

(56) References Cited

U.S. PATENT DOCUMENTS

| | | | | | |
|---|---|---|---|---|---|
| 3,167,995 | A | * | 2/1965 | Londe | 84/421 |
| 4,028,984 | A | * | 6/1977 | Sanchez | 84/422 R |
| 5,105,706 | A | | 4/1992 | Lombardi | |
| 5,945,616 | A | * | 8/1999 | Hoshino | 84/422.3 |
| 6,028,259 | A | * | 2/2000 | Lombardi et al. | 84/422.1 |

FOREIGN PATENT DOCUMENTS

| | | |
|---|---|---|
| JP | 5-297863 | 11/1993 |
| JP | 10-232670 | 9/1998 |
| JP | 11-15466 | 1/1999 |

OTHER PUBLICATIONS

Catalog of SONOR (in Germany), published in 1997, pp. 14–15. (Please see the attached technical comments regarding this publication).

* cited by examiner

*Primary Examiner*—Robert E. Nappi
*Assistant Examiner*—Kim Lockett
(74) *Attorney, Agent, or Firm*—Dickstein, Shapiro, Morin & Oshinsky, LLP.

(57) ABSTRACT

A musical instrument stand such as a hi-hat stand equipped with hi-hat cymbals is basically constructed a stand member, a pedal device containing a pedal frame and a pedal, and a stand leg unit corresponding to a foldable tripod containing three legs. The stand leg unit vertically supports the stand member together with the pedal frame of the pedal device, which is placed on a floor. Herein, first, second and third legs of the stand leg unit are spread on the floor and are subjected to nonuniform arrangement such that a first angle is set between the first and second legs and between the second and third legs, while a second angle is set between the first and third legs. Preferably, the first angle ranges between 100° and 110°, and the second angle ranges between 140° and 160°. The pedal is arranged in an area that lies between the first and third legs, which are widely spread with the second angle in plan view. In order to implement additional pedal setting using double drum pedals, an additional pedal is arranged in proximity to the pedal substantially in the area between the first and third legs. Providing a widely spread area between the first and third legs in plan view allows the additional pedal setting with ease and clears areas around a performer's foot for depressing the pedal(s). Thus, it is possible to improve stability and performability in playing the cymbals.

3 Claims, 3 Drawing Sheets

MUSICAL INSTRUMENT STAND

BACKGROUND OF THE INVENTION

1. Field of the Invention

This invention relates to stands used for musical instruments such as drum kits, and particularly to stands of hi-hat cymbals.

This application is based on Patent Application No. Hei 11-287975 filed in Japan, the content of which is incorporated herein by reference.

2. Description of the Related Art

Musical instruments such as drum kits consisting of sets of drums and cymbals use various types of stands such as stands of hi-hat cymbals (hereinafter, referred to as "hi-hat stands"). Herein, the hi-hat stand supports hi-hat cymbals, i.e., a pair of cymbals being arranged in a "face-to face" manner.

Normally, the hi-hat stand employs a structure in which a stand member is supported by a stand leg unit and a pedal frame in order to secure stability in performance of cymbals. The stand leg unit is normally constructed by a "foldable" tripod consisting of three legs. It is also known that some stand leg unit is constructed by two legs.

FIG. 3 is a perspective view showing a setting state of a conventional hi-hat stand which is supported by a tripod consisting of three legs and is equipped with double drum pedals. FIG. 4 shows a positional relationship between the three legs and pedal, while FIG. 5 shows a positional relationship between the three legs and pedals. As shown in FIG. 3, a hi-hat stand 5 is mainly constructed by a pair of cymbals consisting of a lower fixed cymbal 1A and an upper moving cymbal 1B, a stand member 2 for supporting the cymbals 1, a pedal device 3 for allowing a performer to play with the cymbals 1 and a "foldable" stand leg unit 4 for supporting the stand member 2.

The stand member 2 contains a lower pipe 6, an intermediate pipe 7 and an upper pipe 8, which are assembled together in a vertical direction. That is, the intermediate pipe 7 is connected to an upper end of the lower pipe 6, and the upper pipe 8 is connected to an upper end of the intermediate pipe 7. In addition, the stand member 2 also contains an operation rod 9, which penetrates through the pipes 6, 7 and 8 to freely move up and down. The lower fixed cymbal 1A is attached to an upper end of the upper pipe 8 in an upward manner, while the upper moving cymbal 1B is attached to an upper end of the operation rod 9 in a downward manner to oppositely face with the lower fixed cymbal 1A. The operation rod 9 is normally pressed upwardly by a return spring (not shown) which is inserted into the lower pipe 6. Thus, the upper moving cymbal 1B is normally separated from the lower fixed cymbal 1A in a vertical direction.

The pedal device 3 is constructed by a pedal frame 11, a pedal 12, a heel 13, an interconnection rod 14 and a transmission member 15. The pedal frame 11 is placed on a floor and is attached to a lower end of the stand member 2. The heel 13 is provided as a back-end portion of the pedal 12, which is placed close to the performer. The interconnection rod 14 interconnects the pedal frame 11 and the heel 13 together. The transmission member 15 is constructed by a belt or else, which interconnects a lower end of the operation rod 9 and a front end of the pedal 12 together. Herein, the front end of the pedal 12 is placed close to the stand member 2. In order to play the cymbals, the performer depresses the pedal 12 with his/her foot to lower the operation rod 9 against spring force of the return spring, so that the upper moving cymbal 1B strikes the lower fixed cymbal 1A to produce a cymbal sound.

The pedal frame 11 is made of light metals such as aluminum alloy. Namely, the pedal frame 11 is constructed by a plate-shaped lower frame portion 11A and a gate-shaped support portion 11B. The lower frame portion 11A is directly placed on the floor, and the support portion 11B vertically stands from the lower frame portion 11A. Herein, back ends of the interconnection member 14 are detachably interconnected with the lower frame portion 11A. Thus, it is possible to secure a constant relative distance between the lower frame portion 11A and the heel 13. In addition, a lower end of the lower pipe 6 is fixed to a center of an upper surface of the gate-shaped support portion 11B.

The stand leg unit 4 is constructed by "foldable" three legs 16*a*, 16*b*, 16*c* and three stays 18*a*, 18*b*, 18*c* as well as a first metal fitting 17 and a second metal fitting 19. As shown in FIGS. 4 and 5, the three legs 16*a*, 16*b*, 16*c* are arranged about the stand member 2 with equal angles therebetween. Upper ends of the legs 16*a*, 16*b*, 16*c* are connected to a prescribed position of the intermediate pipe 7 by means of the first metal fitting 17. The stays 18*a*, 18*b*, 18*c* are respectively provided and connected with intermediate portions of the legs 16*a*, 16*b*, 16*c*. Ends of the stays 18*a*, 18*b*, 18*c* are connected to a prescribed position of the lower pipe 6 by means of the second metal fitting 19. Thus, the stand leg unit 4 supports the stand member 2 in a stable manner together with the pedal frame 11. The three legs are subjected to uniform arrangement using an equal angle therebetween. That is, an angle θ (i.e., 120°) is provided between two adjacent legs, namely, legs 16*a* and 16*b*, legs 16*b* and 16*c*, and legs 16*a* and 16*c* within the three legs. In a normal use condition, the hi-hat stand is not connected with the double drum pedals 21, wherein the stand leg unit 4 is arranged together with the stand member 2 as shown in FIG. 4 such that the legs 16*a*, 16*c* are arranged in obliquely front sides of the stand member 2 while the leg 16*b* is arranged in a back side of the stand member 2.

The double drum pedals 21 allow the performer to rapidly and repeatedly hit a bass drum 22 multiple times. Namely, the double drum pedals 21 contain a first pedal 23A and a second pedal 23B. The second pedal 23B is installed on a pedal frame 24 (see a right section of FIG. 3), which pivotally supports a first rotation shaft 25A and a second rotation shaft 25B respectively. A first beater 26A and a second beater 26B are respectively attached to the first rotation shaft 25A and the second rotation shaft 25B. On the other hand, the first pedal 23A is installed on a pedal frame 27, which pivotally supports a rotation shaft 28. The rotation shaft 28 is interconnected with the first rotation shaft 25A by means of a universal joint 29. Thus, it is possible to independently operate the first beater 26A and the second beater 26B in response to depression of the first pedal 23A and the second pedal 23B. The first pedal 23A is arranged in proximity to the pedal 12 of the hi-hat stand 5. So, the performer selectively depresses the pedal 12 or the first pedal 23A by his/her left foot, whilst the performer depresses the second pedal 23B by his/her right foot. In the normal use condition shown in FIG. 4, if a user (or performer) intends to additionally arrange the first pedal 23A in proximity to the pedal 12, the leg 16*c*, which is placed in a right side of the pedal 12 within the three legs, acts as an obstruction to additional setting of the first pedal 23A. To allow the additional setting of the first pedal 23A, the user rotates the three legs of the stand leg unit 4 by 30° or so in a counterclockwise direction with respect to the stand member 2 as shown in FIG. 5.

As described above, the conventional hi-hat stand 5 normally employs the aforementioned structure in which the stand member 2 is supported by the stand leg unit 4 together with the pedal frame 11. Herein, the stand leg unit 4 is constructed by the three legs 16*a*, 16*b*, 16*c*, which provides the performer with complicated troublesome arrangement of parts of the hi-hat stand around his/her foot. For this reason, the conventional hi-hat stand 5 raises a problem in that the performer's foot may come into contact with the legs 16*a*, 16*c* to obstruct pedal operations of the performer. Particularly, the performer may suffer from troubles in performance of a drum set that uses the double drum pedals 21 with the hi-hat stand 5. In that case, when the first pedal 23A is additionally arranged in a right side of the pedal 12 of the hi-hat stand 5, an interval of distance measured between the leg 16*c* and the first pedal 23A (see FIG. 5) is small because of a relatively small angle θ (=120°) being provided between the adjacent legs 16*a* and 16*c*. That is, the conventional hi-hat stand 5 suffers from a problem in that it is greatly restricted in additional pedal setting.

To solve the aforementioned problems, engineers propose hi-hat stands whose stand leg unit is constructed by two legs. Examples are disclosed by various papers such as Japanese Unexamined Patent Publication No. Hei 10-232670 and U.S. Pat. No. 5,105,706. However, such hi-hat stands are complicated in structure because of increasing numbers of parts. In addition, those hi-hat stands are expensive in manufacturing cost, and users have difficulties in manual operations to handle the hi-hat stands. Further, the hi-hat stands are somewhat damaged in appearance.

SUMMARY OF THE INVENTION

It is an object of the invention to provide a musical instrument stand such as a hi-hat stand that is improved in stability for performance in a normal use condition and that allows additional pedal setting using double drum pedals with ease.

A musical instrument stand of this invention such as a hi-hat stand equipped with hi-hat cymbals is basically constructed a stand member, a pedal device containing a pedal frame and a pedal, and a stand leg unit corresponding to a foldable tripod containing three legs. In response to depression on the pedal, an upper moving cymbal strikes a lower fixed cymbal by means of an operation rod, which is inserted in the stand member and is interconnected with a front end of the pedal being depressed by a performer.

In the musical instrument stand, the stand leg unit vertically supports the stand member together with the pedal frame of the pedal device, which is placed on a floor. Herein, first, second and third legs of the stand leg unit are spread on the floor and are subjected to nonuniform arrangement such that a first angle is set between the first and second legs and between the second and third legs, while a second angle is set between the first and third legs. Preferably, the first angle ranges between 100° and 110°, and the second angle ranges between 140° and 160°. The pedal is arranged in an area that lies between the first and third legs, which are widely spread with the second angle in plan view. In order to implement additional pedal setting using double drum pedals, for example, an additional pedal is arranged in proximity to the pedal substantially in the area between the first and third legs. Providing a widely spread area between the first and third legs in plan view allows the additional pedal setting with ease and clears areas around a performer's foot for depressing the pedal(s). Thus, it is possible to improve stability and performability in playing the cymbals.

BRIEF DESCRIPTION OF THE DRAWINGS

These and other objects, aspects and embodiments of the present invention will be described in more detail with reference to the following drawing figures, of which.

DESCRIPTION OF THE PREFERRED EMBODIMENTS

This invention will be described in further detail by way of examples with reference to the accompanying drawings.

Figure 2:
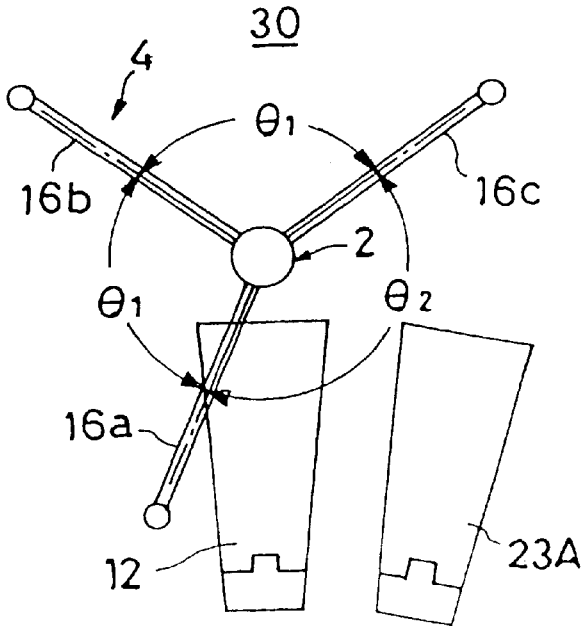
FIG. 2 is a simplified plan view showing a positional relationship between three legs and pedals of the hi-hat stand in response to additional pedal setting.
Figure 3:
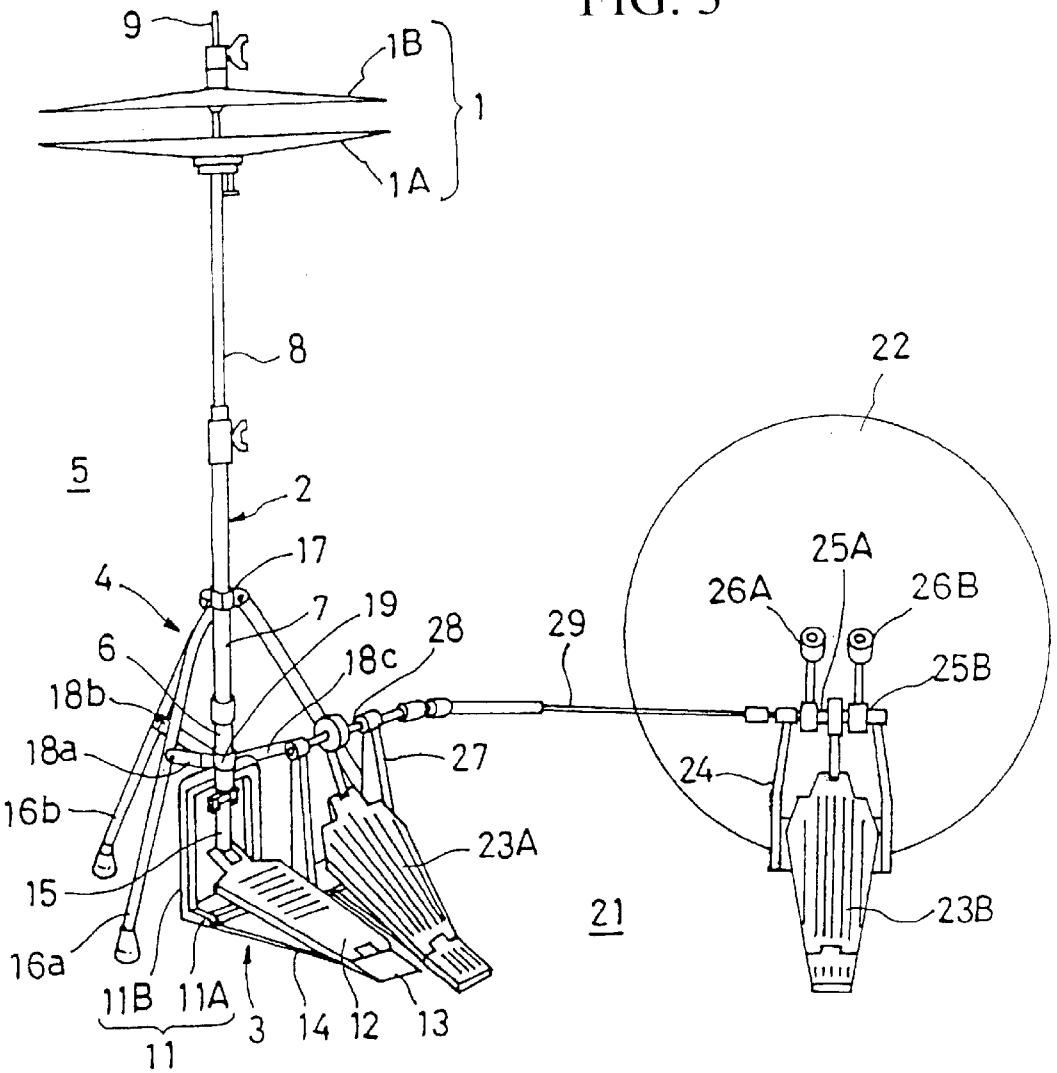
FIG. 3 is a perspective view showing a conventional hi-hat stand which uses foldable three legs for supporting a stand member and which is connected with double drum pedals.

The preferred embodiment of this invention is provided as an application to a hi-hat stand, a basic construction of which is similar to one shown in FIG. 3. Now, the preferred embodiment of this invention will be described with reference to FIGS. 1 and 2, wherein parts identical to those shown in FIG. 3 are designated by the same reference numerals, hence, the description thereof will be omitted.

Figure 1:
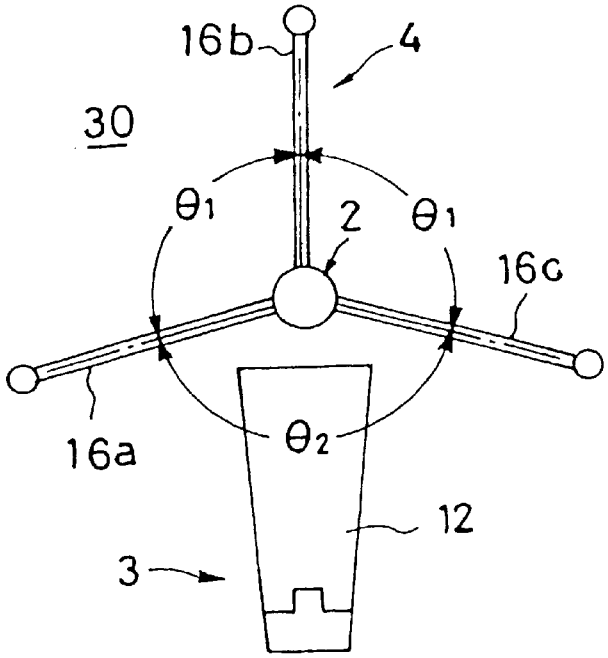
FIG. 1 is a simplified plan view showing a positional relationship between three legs and a pedal of a hi-hat stand in a normal use condition in accordance with a preferred embodiment of the invention.

FIG. 1 shows a positional relationship between three legs and a single pedal of a hi-hat stand 30 which is set in a normal use condition. FIG. 2 shows a positional relationship between three legs and two pedals of the hi-hat stand 30 which additionally installs double drum pedals (21).

The hi-hat stand 30 of the present embodiment is constructed similar to the hi-hat stand 5 shown in FIG. 3, namely, the hi-hat stand 30 is mainly constructed by a stand member 2 for supporting cymbals 1, a pedal device 3 used for performance of the cymbals 1 and a foldable stand leg unit 4 which contains three legs (namely, first, second, third legs) 16*a*, 16*b*, 16*c* to support the stand member 2. The present embodiment is characterized by nonuniform arrangement of the legs of the stand leg unit 4. That is, the three legs of the stand leg unit 4 employed in the conventional hi-hat stand 5 are uniformly arranged with equal angles (θ) therebetween, while the three legs of the stand leg unit 4 employed in the hi-hat stand 30 are uniformly arranged with different angles (namely, first and second angles θ1, θ2 where θ1<θ2) therebetween. That is, the first angle θ1 is provided between the first leg 16*a* and the second leg 16*b* and is also provided between the second leg 16*b* and the third leg 16*c*, whist the second angle θ2 is provided between the first leg 16*a* and the third leg 16*c*. Herein, the first angle θ1 ranges between 100° and 110°, preferably, it is 105°. If the second angle θ2 ranges between 140° and 160°, preferably, it is 150°. If the second angle θ2 is decreased to be under 140°, it may approach the foregoing angle θ(=120°) employed in the conventional uniform arrangement of the legs to cause obstruction to additional pedal setting of the double drum pedals. In the present embodiment, it is not preferable to decrease the second angle θ2 so much because a degree of freedom in the additional pedal setting is to be reduced. That is, if the second angle θ2 is decreased to approach the foregoing angle θ, the first pedal 23A must be arranged in proximity to the third leg 16*c* to cause the foregoing drawbacks. In addition, if the second angle θ2 is increased to be above 160°, the first leg 16*a* and the third leg 16*c* are arranged to be substantially in line so that the three legs 16*a*, 16*b*, 16*c* are arranged like a T-formation in plan view (or bottom view). Because the first leg 16*a* and the third leg 16*c* are substantially arranged in line, the hi-hat stand 30 is likely to fall down in a front direction of a performer with ease. As described above, it is not preferable to increase or decrease the second angle θ2 to be under or above the prescribed range of angles (140°–160°).

Figure 4:
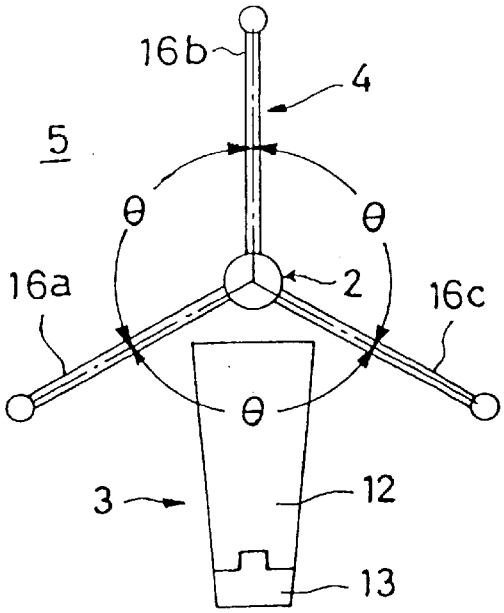
FIG. 4 is a simplified plan view of the hi-hat stand that shows a positional relationship between three legs and a pedal in a normal use condition.
Figure 5:
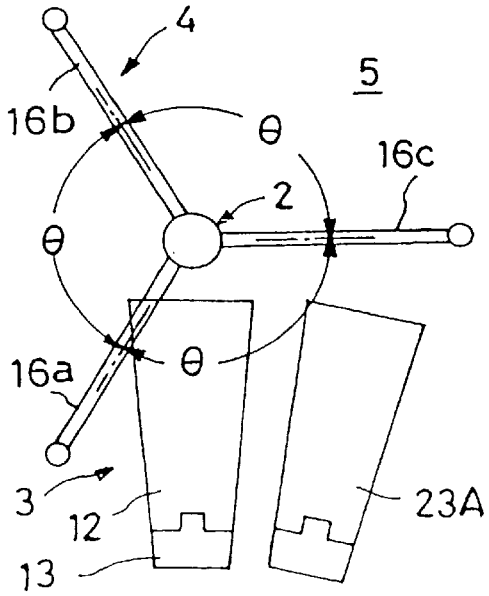
FIG. 5 is a simplified plan view of the hi-hat stand that shows a positional relationship between three legs and pedals in response to additional pedal setting.

In the normal use condition, setting of the hi-hat stand 30 of the present embodiment is made as shown in FIG. 1 to fix the stand leg unit 4 and the stand member 2 together. That is, the first leg 16*a* and the third leg 16*c* are arranged in obliquely front sides of the stand member 2. In addition, the pedal 12 is arranged between the legs 16*a* and 16*c* so that the second leg 16*b*, stand member 2 and pedal 12 are aligned substantially in line. In the conventional arrangement of the hi-hat stand 5 in the normal use condition shown in FIG. 4, end portions of the legs 16*a* and 16*c* are arranged to obliquely approach the pedal 12, which may obstruct pedal operations of the performer. As compared with the conventional arrangement of the hi-hat stand 5 in the normal use condition, the present embodiment is improved such that end portions of the legs 16*a* and 16*c* are arranged in front sides of the pedal 12 in FIG. 1. This clears areas around the performer's foot in movement to ease the pedal operations.

In order to additionally install the double drum pedals 21 with the hi-hat stand 30, the stand leg unit 4 is rotated in a counterclockwise direction and is fixed with the stand member 2 as shown in FIG. 2. In FIG. 2, the first leg 16*a* is arranged in a left side of the pedal 12 to partially overlap with the pedal 12 in plan view. In addition, the second leg 16*b* and the third leg 16*c* are arranged in obliquely back sides of the stand member 2. Under a condition where the first angle θ1 is set to 105° and the second angle θ2 is set to 150°, counterclockwise rotation of the stand leg unit 4 is made by a prescribed angle, which can be increased up to 52.5° or so. As compared with the conventional hi-hat stand 5 shown in FIG. 3, the present embodiment allows rotation in arrangement of the stand leg unit with a relatively large angle. This broadens an interval of distance between the third leg 16*c* and the first pedal 23A of the double drum pedals 21. In the conventional hi-hat stand 5, the first pedal 23A should be arranged in proximity to the third leg 16*c* because of small rotation in arrangement of the stand leg unit 4, so the user must carefully arrange the first pedal 23A such that the pedal frame 24 will not come in contact with the third leg 16*c*. In contrast to the conventional hi-hat stand 5, the hi-hat stand 30 of the present embodiment is improved such that the additional pedal setting can be easily made without considering a possibility in which the pedal frame 24 of the first pedal 23A easily comes in contact with the third leg 16*c*.

In the present embodiment, the stand leg unit 4 necessarily installs three legs 16*a*, 16*b*, 16*c*, so it is possible to support the stand member 2 in a stable manner. This invention exclusively contributes to modification of angles being formed between adjacent legs. So, this invention does not increase a number of parts required for assembly of the hi-hat stand. In addition, this invention does not damage the appearance of the hi-hat stand. Further, it is possible to manufacture the hi-hat stand of this invention without substantially increasing the cost being required for manufacturing the conventional hi-hat stand.

Incidentally, the present embodiment refers to an application of this invention to the hi-hat stand 30. Of course, this invention is not necessarily limited in such an application. Hence, this invention is applicable to all kinds of musical instrument stands which are equipped with pedals.

As described heretofore, this invention has a variety of technical features and effects, which are summarized as follows:

(1) This invention provides a musical instrument stand (e.g., hi-hat stand 30) having a stand leg unit (e.g., foldable tripod) whose three legs are subjected to nonuniform arrangement. That is, two out of three angles being respectively formed between adjacent legs within the three legs are set to a first angle (θ1) which ranges between 100° and 110°, and remaining one is set to a second angle (θ2) which ranges between 140° and 160°. In a normal use condition, a pedal (12) is arranged between adjacent two legs (16*a*, 16*c*) which are separated from each other by the second angle. This clears areas around the performer's foot to ease pedal operations in the normal use condition of the musical instrument stand. Hence, it is possible to improve performability of the musical instrument stand.

(2) In order to make additional pedal setting using double drum pedals on the musical instrument stand, this invention merely requires the user to change or modify the angles of the legs with respect to the stand member. This eases the additional pedal setting of the double drum pedals to be additionally equipped with the musical instrument stand. In addition, it is possible to increase a degree of freedom in the additional pedal setting. Further, this invention can be realized by a simple structure without increasing a number of parts being required for assembly of the musical instrument stand. So, the musical instrument stand of this invention can be easily manufactured with relatively small cost and without damaging appearance thereof.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds are therefore intended to be embraced by the claims.

What is claimed is:

1. A musical instrument stand comprising:

a stand member;

a pedal device that is placed on a floor and is fixed to a lower portion of the stand member, wherein the pedal device contains a pedal frame for supporting the stand member and a pedal; and a stand leg unit for supporting the stand member together with the pedal frame of the pedal device, wherein the stand leg unit is constructed by first, second and third legs which are subjected to nonuniform arrangement such that a first angle ranging between 100° and 110° is set between the first and second legs and between the second and third legs, while a second angle ranging between 140° and 160° is set between the first and third legs, so that the pedal of the pedal device is arranged in an area that lies between the first and third legs in plan view.

2. A musical instrument stand comprising:

a stand member;

a pedal device that contains a pedal and a pedal frame for vertically supporting the stand member and that is placed on a floor;

a stand leg unit corresponding to a foldable tripod containing first, second and third legs, which are spread on the floor to support the stand member together with the pedal frame of the pedal device; and an additional pedal that is additionally set in proximity to the pedal of the pedal frame, wherein a first angle ranging between 100° and 110° is set between the first and second legs and between the second and third legs, while a second angle ranging between 140° and 160° is set between the first and third legs, so that the pedal is arranged together with the additional pedal substantially in an area that lies between the first and third legs in plan view.

3. A musical instrument stand comprising:

a stand member; and a stand leg unit which supports the stand member and is constructed by a first leg, a second leg and a third leg, wherein at least two of the first, second and third legs are rotatably attached to the stand member, and wherein a first angle formed by the first and second legs is changeable between 100° and 110°, a second angle formed by the second and third legs is changeable between 100° and 110°, and a third angle formed by the first and third legs is changeable between 140° and 160°.

* * * * *